US009463362B2

(12) United States Patent
Sato et al.

(10) Patent No.: US 9,463,362 B2
(45) Date of Patent: Oct. 11, 2016

(54) GOLF CLUB AND SHAFT

(71) Applicant: BRIDGESTONE SPORTS CO., LTD., Tokyo (JP)

(72) Inventors: Fumiaki Sato, Tokyo (JP); Souichirou Sugawara, Chichibu (JP); Tomotaka Ishihara, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/703,121

(22) Filed: May 4, 2015

(65) Prior Publication Data

US 2015/0352416 A1 Dec. 10, 2015

(30) Foreign Application Priority Data

Jun. 9, 2014 (JP) ..... 2014-118812

(51) Int. Cl.
*A63B 53/10* (2015.01)

(52) U.S. Cl.
CPC ..... *A63B 53/10* (2013.01); *A63B 2209/023* (2013.01)

(58) Field of Classification Search
CPC ..... A63B 53/10; A63B 2209/023
See application file for complete search history.

(56) References Cited

U.S. PATENT DOCUMENTS 5,735,753 A * 4/1998 Hoffmeyer ..... A63B 53/10 473/318
5,938,542 A * 8/1999 Hoffmeyer ..... A63B 53/10 473/318
6,354,957 B1 * 3/2002 Saito ..... A63B 53/10 473/289
6,805,642 B2 * 10/2004 Meyer ..... A63B 60/54 473/320
6,860,821 B2 * 3/2005 Unosawa ..... A63B 53/10 473/320
6,866,593 B1 * 3/2005 Cheng ..... A63B 53/10 473/320
7,500,922 B2 * 3/2009 Takeuchi ..... A63B 53/10 473/319
7,517,288 B2 * 4/2009 Kumamoto ..... A63B 53/10 473/319
7,803,063 B2 * 9/2010 Kumamoto ..... A63B 53/10 473/319
8,057,617 B2 * 11/2011 Fujimoto ..... A63B 53/10 156/187
8,876,628 B2 * 11/2014 Hasegawa ..... A63B 53/10 473/318
8,900,068 B2 * 12/2014 Hasegawa ..... A63B 53/10 473/316
8,979,666 B2 * 3/2015 Hasegawa ..... A63B 53/10 473/319

(Continued)

FOREIGN PATENT DOCUMENTS

JP 09234256 A * 9/1997
JP 10-155951 A 6/1998

(Continued)

*Primary Examiner* — Stephen Blau
(74) *Attorney, Agent, or Firm* — Sughrue Mion, PLLC

(57) ABSTRACT

The present invention provides a golf club shaft. The shaft is made of a fiber reinforced resin. When a position 100 mm apart from a distal end of the shaft is represented by P1, a position 200 mm apart by P2, a position 500 mm apart by P3, and a position 1,000 mm apart by P4, thicknesses at the positions are defined as P1: not more than 1.0 mm, P2: not more than 0.9 mm, P3: not more than 0.6 mm and P4: not more than 0.6 mm. Each section between the positions has a thickness larger than a thickness transition obtained by connecting the thicknesses at the positions by a straight line. The shaft includes a plurality of prepregs which include first prepregs containing carbon fibers and a second prepreg containing a high specific gravity material.

10 Claims, 3 Drawing Sheets

(56) References Cited

U.S. PATENT DOCUMENTS

| | | | | |
|---|---|---|---|---|
| 9,079,075 | B2 * | 7/2015 | Nakamura | A63B 53/00 |
| 2002/0123392 | A1 * | 9/2002 | Yamada | A63B 53/10 473/319 |
| 2005/0197203 | A1 * | 9/2005 | Cheng | A63B 53/10 473/320 |
| 2006/0058111 | A1 * | 3/2006 | Kumamoto | A63B 53/10 473/319 |
| 2006/0211511 | A1 * | 9/2006 | Cheng | A63B 53/10 473/316 |
| 2007/0105644 | A1 * | 5/2007 | Kumamoto | A63B 53/10 473/316 |
| 2009/0209360 | A1 * | 8/2009 | Lee | A63B 53/10 473/319 |
| 2009/0326688 | A1 * | 12/2009 | Thomas | A63B 69/3623 700/91 |
| 2013/0035177 | A1 * | 2/2013 | Wakabayashi | A63B 53/10 473/319 |
| 2013/0137530 | A1 * | 5/2013 | Ito | A63B 53/10 473/320 |
| 2015/0038254 | A1 * | 2/2015 | Nakamura | A63B 53/10 473/319 |
| 2015/0157906 | A1 * | 6/2015 | Shimono | A63B 53/10 473/319 |
| 2015/0297963 | A1 * | 10/2015 | Shimono | A63B 53/10 473/319 |

FOREIGN PATENT DOCUMENTS

| | | | | | |
|---|---|---|---|---|---|
| JP | 10328340 | A | * | 12/1998 | |
| JP | 11009743 | A | * | 1/1999 | |
| JP | 11309226 | A | * | 11/1999 | |
| JP | 3017949 | B2 | | 3/2000 | |
| JP | 2001-120696 | A | | 5/2001 | |
| JP | 2001259096 | A | * | 9/2001 | |
| JP | 2002-35185 | A | | 2/2002 | |
| JP | 2002-65915 | A | | 3/2002 | |
| JP | 2002085608 | A | * | 3/2002 | |
| JP | 2003180890 | A | * | 7/2003 | |
| JP | 3617797 | B2 | | 2/2005 | |
| JP | 2005341991 | A | * | 12/2005 | |
| JP | 2007-190107 | A | | 8/2007 | |
| JP | 2007203120 | A | * | 8/2007 | |
| JP | 2007252574 | A | * | 10/2007 | |
| JP | 2007307169 | A | * | 11/2007 | |
| JP | 2009-22622 | A | | 2/2009 | |
| JP | 4643806 | B2 | | 3/2011 | |
| JP | 2012010799 | A | * | 1/2012 | |
| JP | 5080886 | B2 | | 11/2012 | |
| JP | 2013-212186 | A | | 10/2013 | |
| JP | 2013-220285 | A | | 10/2013 | |
| JP | WO 2014034803 | A1 | * | 3/2014 | A63B 53/10 |

* cited by examiner

GOLF CLUB AND SHAFT

BACKGROUND OF THE INVENTION

1. Field of the Invention

The present invention relates to a golf club and a shaft thereof and, more particularly, to a shaft made of a fiber reinforced resin and a golf club including the shaft.

2. Description of the Related Art

A carbon shaft is widely used as a golf club shaft made of a fiber reinforced resin. The carbon shaft is made of a fiber reinforced resin containing carbon fibers as main fibers. As a method of manufacturing the carbon shaft, a sheet winding method is known (Japanese Patent Laid-Open Nos. 2002-35185 and 2007-190107). In this manufacturing method, a prepreg sheet is wound around a mandrel (cored bar), and a wrapping tape is further wound. After that, the prepreg is hardened by heating, thereby manufacturing a shaft.

In general, a golf club shaft made of FRP mainly includes a straight layer in which fibers are arranged almost in parallel to the shaft axis and an angle layer in which fibers are arranged obliquely with respect to the shaft axis. A reinforcing layer is further added to the periphery on the distal end side (head side) or on the proximal end side in some cases. For example, Japanese Patent Laid-Open No. 2002-35185 describes a shaft in which a prepreg made of a metal fiber reinforced resin is arranged only on the head attachment side including a portion in contact with the end face of the neck.

FRP has a high specific strength and a high specific modulus and is therefore suitable for weight reduction of a shaft. When the shaft is made light, the whole golf club becomes light. For this reason, the so-called head speed at swing (the speed of the golf club head portion at the instant of ball impact) increases, and a longer distance can be attained.

Weight reduction of the shaft improves the head speed and increases the distance. On the other hand, since the load that the golfer feels in swing is too small, the swing may be unstable, or the golfer may feel as if his/her physical powers were not sufficiently exerted.

For example, Japanese Patent Laid-Open No. 2007-190107 describes a shaft that adds a mass of about 1 to 5 g near the point of center of gravity of the shaft by, for example, enfolding a metal fiber reinforced resin prepreg, thereby improving the sensation or impression of a golfer such as a weight and rigidity while suppressing increases in the physical amounts such as a mass and a moment of inertia.

If the metal fiber reinforced resin prepreg is wound to weight only on the head attachment side including the portion in contact with the end face of the neck, as in Japanese Patent Laid-Open No. 2002-35185, the hitting feel or swing-through feel degrades, and the weight balance of the shaft becomes poor. When only the head attachment side including the portion in contact with the end face of the neck is weighted, the head can be light to keep the balance of the golf club. However, if the head is made light, the initial speed of a hit ball lowers.

In the shaft that weights near the point of center of gravity, as in Japanese Patent Laid-Open No. 2007-190107, the increase in the moment of inertia caused by addition of the weight is small. If the weight amount is increased to obtain a sufficiently large moment of inertia, the shaft becomes heavy and hard to swing.

SUMMARY OF THE INVENTION

It is an object of the present invention to provide a shaft having a large moment of inertia, easy to swing, and having a satisfactory swing-through feel, and a golf club including the shaft.

According to an aspect of the present invention, there is provided a shaft for a golf club, which is made of a fiber reinforced resin, wherein when a position 100 mm apart from a distal end of the shaft is represented by P1, a position 200 mm apart by P2, a position 500 mm apart by P3, and a position 1,000 mm apart by P4, thicknesses at the positions are defined as P1: not more than 1.0 mm P2: not more than 0.9 mm P3: not more than 0.6 mm P4: not more than 0.6 mm each section between the positions has a thickness larger than a thickness transition obtained by connecting the thicknesses at the positions by a straight line, the shaft comprises a plurality of prepregs, the plurality of prepregs include a plurality of first prepregs and at least one second prepreg, the plurality of first prepregs comprise prepregs containing carbon fibers, the second prepreg comprises a prepreg containing a material having a specific gravity higher than the specific gravity of the prepregs containing carbon fibers, and a weight of the shaft is 35 g (inclusive) to 45 g (inclusive).

According to another aspect of the present invention, there is provided a shaft for a golf club, comprising a plurality of prepregs, wherein the plurality of prepregs include a plurality of first prepregs and at least one second prepreg, the plurality of first prepregs comprise prepregs containing carbon fibers, the second prepreg comprises a prepreg containing a material having a specific gravity higher than the specific gravity of the prepregs containing carbon fibers, the shaft has a thickness of not more than 1.0 mm at a position 100 mm apart from a distal end, the shaft has a thickness of not more than 0.9 mm at a position 200 mm apart from the distal end, the shaft has a thickness of not more than 0.6 mm at a position 500 mm apart from the distal end, the shaft has a thickness of not more than 0.6 mm at a position 1,000 mm apart from the distal end, and a weight of the shaft is 35 g (inclusive) to 45 g (inclusive).

According to still another aspect of the present invention, there is provided a golf club including the shaft.

Further features of the present invention will become apparent from the following description of exemplary embodiments (with reference to the attached drawings).

DESCRIPTION OF THE EMBODIMENTS

An embodiment will now be described with reference to the accompanying drawings.

Figure 2:
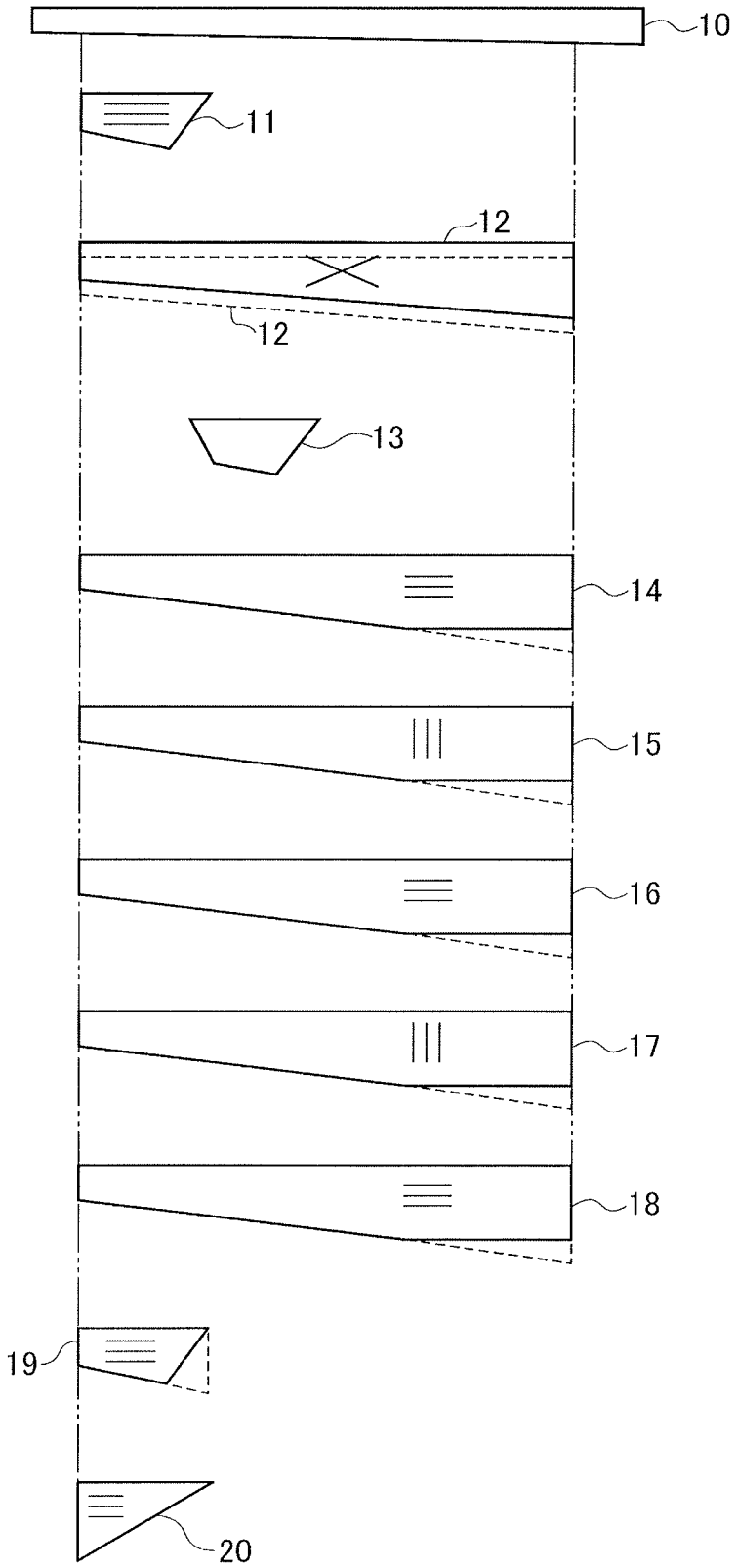
FIG. 2 is an explanatory view of winding of prepregs according to an embodiment.

FIG. 2 is an exploded view showing prepregs so as to explain a method of manufacturing a golf club shaft according to an embodiment of the present invention. In this manufacturing method, a mandrel 10 and prepregs 11 to 20 are used. The central axis of the mandrel 10 is straight. The mandrel 10 has a circular sectional shape perpendicular to the central axis. The mandrel 10 has a tapered shape that is thin on the distal end side (head side) and thick on the proximal end side (grip side). However, the mandrel 10 may partially have an equal diameter portion with a predetermined diameter.

Preferably, after a release agent is applied to the surface of the mandrel 10, sheet-shaped prepregs 11 to 20 are sequentially wound.

The prepregs 11 to 20 contain carbon fibers and a matrix resin. The prepreg 13 further contains metal fibers or a metal powder. The metal powder is preferably a powder of a metal having a high specific gravity such as tungsten or stainless steel. The metal fibers are preferably fibers of a metal having a high specific gravity such as tungsten, stainless steel, or copper. Note that when containing metal fibers, the prepreg 13 need not contain carbon fibers. The prepreg 13 constructs a weighting portion. When the weighting portion is provided, it is possible to increase the moment of inertia and allow the player to feel a moderate swing weight.

In this embodiment, the prepreg 12 forms an angle layer, each of the prepregs 14, 16, and 18 forms a straight layer, each of the prepregs 15 and 17 forms a hoop layer, and each of the prepregs 11, 19, and 20 forms a reinforcing layer. That is, in this embodiment, the carbon fibers in the prepregs 11, 14, 16, and 18 to 20 are aligned within the range of ±10° with respect to the shaft axis direction. In the prepregs 15 and 17, the carbon fibers are aligned at the angle (within 90°±10°, particularly, within ±5°) of a direction almost perpendicular to the long shaft axis direction. In the prepreg 12, carbon fibers aligned at an angle of +45° and those aligned at an angle of −45° are used. The angle of the carbon fibers is not limited to 45° and preferably falls within the range of 30° to 60°.

The prepregs 12 and 14 to 18 have a length extending along the total length of the shaft. The prepregs 19 and 20 have a length almost 8% to 35% the total length of the shaft so as to be arranged only on the distal end side in the shaft. When the shaft is equally divided into five, first to fifth sections in the axial direction from the distal end side, the prepreg 13 is preferably arranged in the first to third sections, particularly, in the first and second sections. The length of the prepreg 13 in the shaft axis direction is preferably 2% or more, particularly 4% or more to 13% or less, particularly 9% or less of the shaft total length. Note that the prepreg 13 is not arranged in the insertion portion to the hosel on the distal end side in the shaft.

Each of the prepregs 11 to 20 has a width so as to be wound on the outer surface of the mandrel 10 by one or a plurality of turns, for example, one to five turns.

The prepreg 13 has an almost trapezoidal shape whose short sides (a side on the distal end side in the shaft and a side on the proximal end side in the shaft) are oblique with respect to the shaft circumference direction.

When the prepreg 13 is arranged in the inner layer side, and the two short sides of the prepreg 13 are made oblique with respect to the shaft circumference direction, steps formed on two end sides of the weighting portion in the shaft axis direction become moderate. This prevents stress concentration and attains a good outer appearance.

The prepreg 13 is preferably bonded to the prepreg 12 or sandwiched between two prepregs 12. This prevents the prepreg 13 from peeling during the winding operation and attains a good winding operability of the prepreg.

Each of the prepregs 11 to 20 preferably has a thickness of about 0.125 mm or less. As the resin of the prepregs, epoxy resin or the like is preferable.

Figure 3:
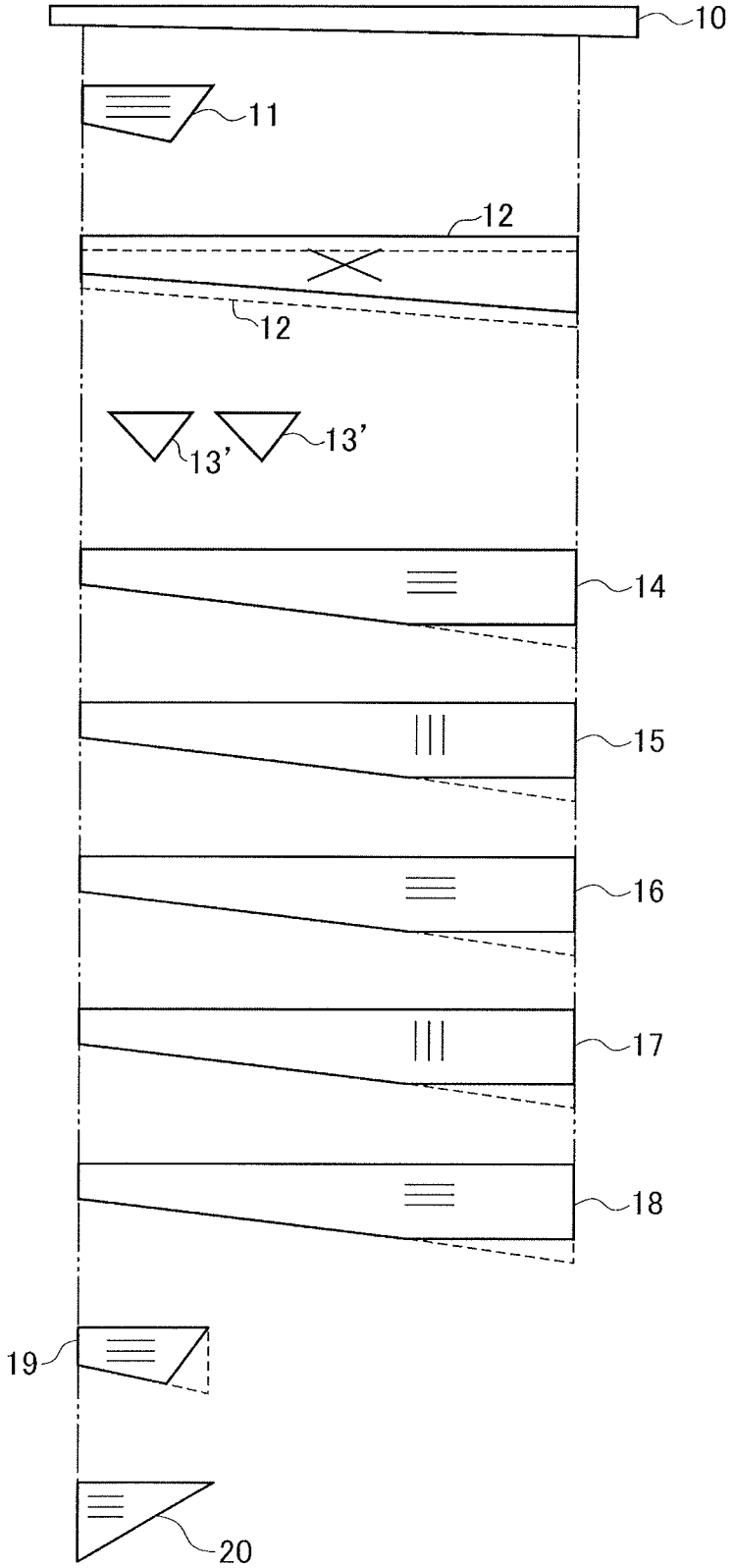
FIG. 3 is an explanatory view of winding of prepregs according to an embodiment.

In FIG. 2, one prepreg 13 is used. However, two or more prepregs 13' may be used, as shown in FIG. 3. Each prepreg 13' is triangular but may have an almost trapezoidal shape formed by truncating a portion near an apex of a triangle.

In FIGS. 2 and 3, the sides of the prepregs 14 to 18 in the shaft axis direction are almost parallel on the grip side of the prepregs 14 to 18. However, a shape as indicated by broken lines may be used. In FIGS. 2 and 3, the short side of the prepreg 19 on the grip side is oblique with respect to the circumferential direction. However, a shape as indicated by broken lines may be used.

In a normal case, it is preferable to wind three to five prepregs containing fibers in the straight direction, two, four, or six prepregs containing fibers in the bias direction, and one to three prepregs containing fibers in the hoop direction.

The operation of winding the prepregs 11 to 20 on the mandrel 10 may be performed manually or using a winding machine (to be also referred to as a rolling machine). After the prepregs 11 to 20 are wound on the mandrel, a wrapping tape winding process is performed. Although not illustrated, the wrapping tape is spirally wound.

After the winding process, a hardening process is performed by heating, and the matrix resin in the prepreg is hardened. After the hardening process, the mandrel 10 is pulled out, and the wrapping tape is removed, thereby obtaining a hardened tubular member (base tube). After the two ends of the base tube are cut as needed, the member is polished to form a golf club shaft.

When the shaft is equally divided into five, first to fifth sections in the axial direction, the weighting portion is preferably arranged in the first to third sections, particularly, in the first and second sections on the distal end side in the shaft except the insertion portion to the hosel. When the weighting portion is provided in such sections, the moment of inertia can be increased by increasing the weight only a little, and the player can feel a moderate swing weight. The shaft is easy to swing and has satisfactory swing-through stability. When the weighting portion is provided on the distal end side in the shaft except the insertion portion to the hosel, the weight balance of the shaft is good. It is not always necessary to reduce the weight of the head, and the initial speed of a ball does not lower.

The distance between the distal end and the front end of the weighting portion (on the distal end side in the shaft) is preferably 50 mm or more, particularly 70 mm or more to 600 mm or less, particularly 450 mm or less. The length of the weighting portion in the shaft axis direction is preferably 50 mm or more, particularly 70 mm or more to 150 mm or less, particularly 100 mm or less.

The weight of the shaft is preferably 35 g or more, particularly 37 g or more to 45 g or less, particularly 42 g or less. The weight of the weighting portion by the prepreg 13 is preferably 15% or less, particularly 10% or less and 4% or more, particularly 6% or more of the shaft weight.

Figure 1:
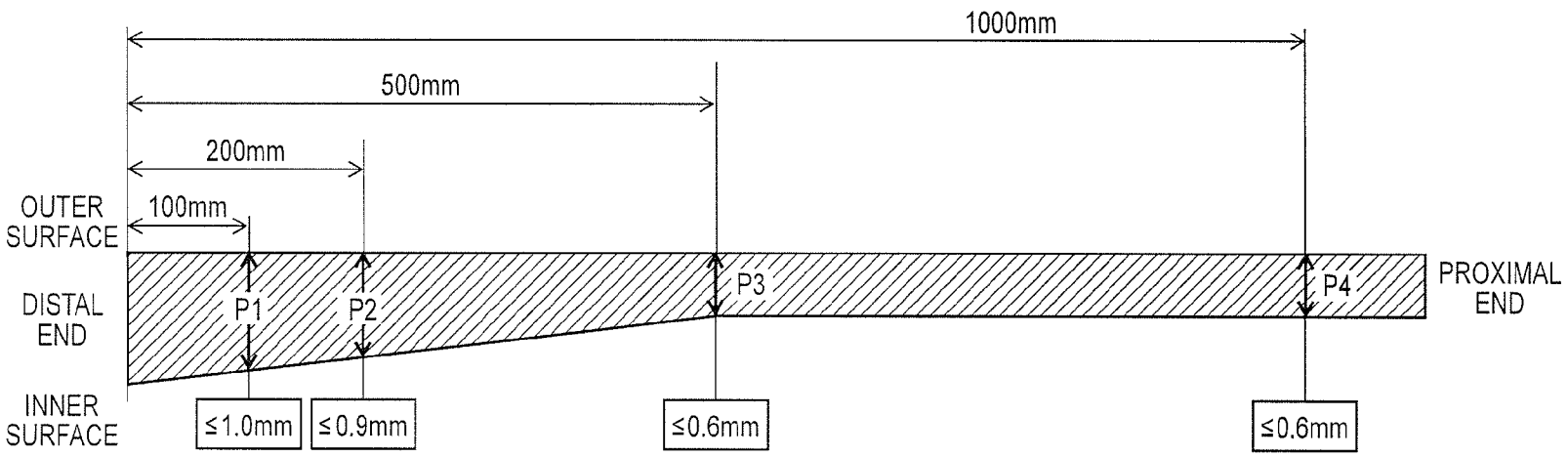
FIG. 1 is a view showing the thickness distribution of a section of a shaft.

A preferable thickness distribution of a thus manufactured shaft will be described with reference to FIG. 1. As shown in FIG. 1, a position 100 mm apart from the distal end of the shaft is represented by P1, a position 200 mm apart by P2, a position 500 mm apart by P3, and a position 1,000 mm apart by P4. The thicknesses at the positions are P1: 1.0 mm or less, particularly 0.95 mm or less and 0.8 mm or more, particularly 0.85 mm or more P2: 0.9 mm or less, particularly 0.85 mm or less and 0.75 mm or more, particularly 0.8 mm or more P3: 0.6 mm or less, particularly 0.55 mm or less and 0.45 mm or more, particularly 0.5 mm or more P4: 0.6 mm or less, particularly 0.55 mm or less and 0.45 mm or more, particularly 0.5 mm or more Each section between the positions has a thickness larger than the thickness transition obtained by connecting the thicknesses at the positions by a straight line. With this thickness distribution, the shaft has a light weight and a sufficient strength.

In the golf club having this shaft, the weighting portion is arranged near the distal end of the shaft except the insertion portion to the hosel. It is therefore possible to effectively increase the moment of inertia on the proximal end of the shaft by a small weight. Although this shaft is light, the player can feel a moderate swing weight and attain stability in swing.

The stacking examples of prepregs shown in FIGS. 2 and 3 are merely examples of the present invention, and any stacking example other than those shown in FIGS. 2 and 3 is possible. In the above description, the prepregs contain carbon fibers as reinforcing fibers. Other types of fibers such as glass fibers, silicon carbide fibers, alumina fibers, aromatic polyamide fibers, or boron fibers may also be mixed.

The present invention is applicable to various kinds of golf clubs such as a wood type, utility type, iron type, and putter type and particularly suitable for a golf club whose shaft length is 40 inches (1,016 cm) or more, particularly 43 inches (1,092 cm) or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-118812, filed Jun. 9, 2014, which is hereby incorporated by reference herein in its entirety.

What is claimed is:

1. A shaft for a golf club, which is made of a fiber reinforced resin, wherein when a position 100 mm apart from a distal end of the shaft is represented by P1, a position 200 mm apart by P2, a position 500 mm apart by P3, and a position 1,000 mm apart by P4, thicknesses at the positions are defined as P1: not more than 1.0 mm P2: not more than 0.9 mm P3: not more than 0.6 mm P4: not more than 0.6 mm each section between the positions has a thickness larger than a thickness transition obtained by connecting the thicknesses at the positions by a straight line, the shaft comprises a plurality of prepregs, said plurality of prepregs include a plurality of first prepregs and at least one second prepreg, said plurality of first prepregs comprise prepregs containing carbon fibers, said second prepreg comprises a prepreg containing a material having a specific gravity higher than the specific gravity of the prepregs containing carbon fibers, and a weight of the shaft is 35 g (inclusive) to 45 g (inclusive).

2. The shaft according to claim 1, wherein said plurality of first prepregs include:

a prepreg arranged along a total length of the shaft and forming an angle layer, in which the carbon fibers are aligned at an angle of 30° to 60° with respect to a long axis of the shaft;

a prepreg arranged along the total length of the shaft and forming a straight layer, in which the carbon fibers are aligned at an angle of ±10° with respect to the long axis of the shaft;

a prepreg arranged along the total length of the shaft or along part of the total length of the shaft and forming a hoop layer, in which the carbon fibers are aligned at an angle of a direction substantially perpendicular to the long axis of the shaft; and a prepreg arranged along part of the total length of the shaft and forming a reinforcing layer, said angle layer is arranged on an inner side of said straight layer, said hoop layer is arranged on an outer side of said angle layer, and said second prepreg is arranged in contact with said angle layer.

3. The shaft according to claim 1, wherein two sides of said second prepreg in a crossing direction crossing a shaft axis direction are oblique with respect to a shaft circumference direction.

4. The shaft according to claim 1, wherein the material is metal fiber.

5. The shaft according to claim 1, wherein the material is a metal powder.

6. The shaft according to claim 1, wherein when the shaft is equally divided into five, first to fifth sections in the shaft axis direction from a distal end side, said second prepreg is arranged in one of the first section or the second section except an insertion portion to a hosel.

7. The shaft according to claim 1, wherein when the shaft is equally divided into five, first to fifth sections in the shaft axis direction from a distal end side, said second prepreg is arranged in one of the first to third sections except an insertion portion to a hosel.

8. The shaft according to claim 1, wherein the weight of said second prepreg is not more than 15% of the weight of the shaft.

9. The shaft according to claim 1, wherein a length of said second prepreg in a shaft axis direction is 50 (inclusive)to 150 mm (inclusive).

10. A golf club including a shaft of claim 1.

* * * * *